United States Patent [19]

Olsson et al.

[11] Patent Number: 4,592,292

[45] Date of Patent: Jun. 3, 1986

[54] METHOD AND APPARATUS FOR ACTIVATING LARGE PARTICLES

[75] Inventors: Mats Olsson, Bromma; Roland Sandström, Skellefteå, both of Sweden

[73] Assignee: ASEA Stal AB, Västerås, Sweden

[21] Appl. No.: 677,528

[22] Filed: Nov. 30, 1984

[51] Int. Cl.[4] ..... F23D 1/00

[52] U.S. Cl. ..... 110/347; 110/245; 110/263

[58] Field of Search ..... 431/1; 110/347, 263, 110/245, 341

[56] References Cited

U.S. PATENT DOCUMENTS

| | | | |
|---|---|---|---|
| 2,945,459 | 7/1960 | Junkermann . | |
| 3,171,465 | 3/1965 | Rydberg | 431/1 |
| 4,221,174 | 9/1980 | Smith et al. | 431/1 X |
| 4,457,695 | 7/1984 | Kummel | 431/1 X |

FOREIGN PATENT DOCUMENTS

| | | |
|---|---|---|
| 472812 | 3/1929 | Fed. Rep. of Germany . |
| 412635 | 10/1980 | Sweden . |
| 281373 | 3/1952 | Switzerland . |
| 228216 | 3/1969 | U.S.S.R. . |

*Primary Examiner*—Edward G. Favors

*Attorney, Agent, or Firm*—Watson, Cole, Grindle & Watson

[57] ABSTRACT

The invention relates to method and apparatus for the combustion of large solid fuels. In order to improve the beneficial effect of sound on combustion are a bed of the fuel located on a grate, the bed of fuel is exposed to a high particle velocity of a sound positively produced by an external low frequency sound generator, the frequency of which is determined by the sound generator, to provide a reciprocating movement of combustion air and combustion gas through the fuel bed. The dimensions of the grate in a plane transverse to the reciprocating movement of combustion air and combustion gas are less than a quarter of the wave length of the sound generated by the sound generator.

16 Claims, 10 Drawing Figures

METHOD AND APPARATUS FOR ACTIVATING LARGE PARTICLES

BACKGROUND OF THE INVENTION

1. Field of the Invention

The present invention relates to a method and apparatus for the combustion of large particles.

2. The Prior Art

As early as in 1961 F. H. Reynst mentioned that it was known that acoustic vibrations have a beneficial effect on combustion. In this connection reference is made to Pulsating Combustion, pp 13–15, The Collected Works of F. H. Reynst, Pergamon Press, New York 1961. Although the vibrations may be only very weak, the relative motion of the gas with respect to the fuel particle which results is sufficient to remove the envelope of combustion products around this particle, resulting in an increase of the combustion rate. Reynst describes the application of this principle to a pulverized coal burner. A mixture of fuel and air is delivered by a fan to a precombustion chamber located between two conical passages flaring in the direction of flow. Volatile components of the fuel are combusted in the precombustion chamber, and the flame is directed into a flame tube. The pulsations of the flame in the precombustion chamber are propagated into the flame tube wherein the column of gas is set in resonance so as to move relatively with respect to the fuel particles, which speeds up the combustion as mentioned above.

Swedish patent specification No. 7701764-8 (publ. No. 412 635) describes a method of combusting atomized solid, liquid or gaseous fuels, which is based on the principle mentioned by Reynst. However, according to this patent specification the vibrations are not generated by the burner flame. Sound energy is supplied to the combustion flame by external means such as a sound emitter, the frequency of the sound ranging from infrasound frequencies to ultrasound frequencies. However, the method of the Swedish patent specification No. 7701764-8 apparently has not yet been utilized practically to any significant extent, which may indicate that it has not been possible so far to develop the method for industrial application.

Similar methods are described in Swiss Pat. No. 281,373 and German Pat. No. 472,812. According to the Swiss patent, vibration is imparted to at least part of the combustion chamber and the flue gases, and according to the German patent, a dispersion of particulate fuel and combustion air as well as secondary combustion air is brought to oscillation.

The USSR Author's Certificate No. 228,216 (V. S. Severyanin) describes a pulsating combustion in a bed whereby the hot grid of the Rijke tube is replaced by a layer of solid fuel in which free oscillation will develop. The effect obtained is, however, relatively low, because only self-generated oscillation is utilized.

U.S. Pat. No. 1,173,708 describes a method for burning fuel wherein the particles of a fuel bed laying on a grate are agitated by pulsating combustion air supplied from below through the grate. The particles of fuel are suspended and floated by the air and are permitted to settle in the time intervals between the pulsations.

SUMMARY OF THE INVENTION

The primary object of the present invention is to provide a combustion method which further improves the beneficial effect of sound on combustion and which can be industrially applied in a practical manner and especially without the necessity of particulating the fuel to be combusted.

According to the invention, a high particle velocity sound is used to provide a reciprocating movement of combustion air and combustion gas through a bed of solid fuel particles on a grate, the high particle velocity sound having a maximum frequency of 60 Hz and a wavelength which is greater than twice the dimensions of the grate in a plane which is transverse to the reciprocating movement of the combustion air and combustion gas. The high particle velocity sound is created by a low frequency generator which preferably includes a tubular resonator. The grate can be located in a chamber to which the tubular resonator is connected, or in a chamber which is located along the length of the tubular resonator.

For an explanation of the invention in more detail, reference is made to the accompanying drawings which disclose several embodiments of the invention.

DETAILED DESCRIPTION OF THE PREFERRED EMBODIMENTS

Figure 1:
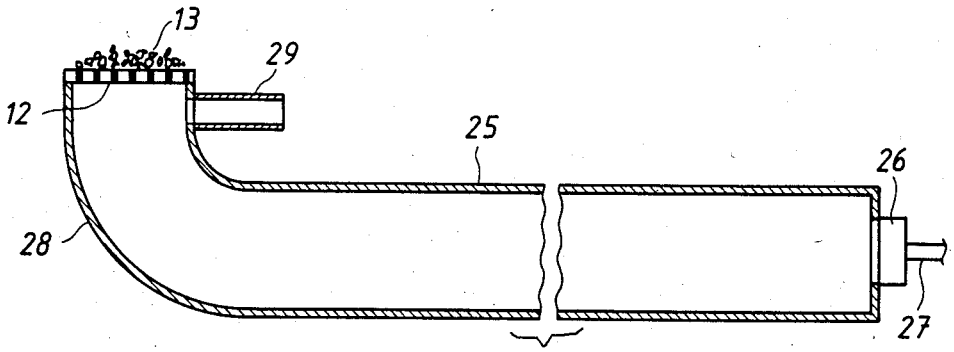
FIG. 1 is a diagrammatic vertical cross-sectional view of a combustion apparatus according to the invention with a quarter-wave resonator.

In FIG. 1, a tubular resonator 25, closed at one end and open at the other end, the length of which is a quarter of the wave length of the sound emitted together with a feeder 26, herein termed exigator for the purpose of this specification, forms a low frequency sound generator, the exigator being connected to a supply conduit 27 for driving gas. The generator can be of the positive feedback type described in U.S. Pat. No. 4,359,962. However, any other infrasound generator can be used for the purpose of the invention.

The maximum frequency of the sound should be 60 Hz, preferably the maximum frequency should be 30 Hz; however, 20 Hz or less would be optimal.

The resonator has a curved open end portion 28 supporting a grate 12 mounted in the opening or closely above. The grate supports a bed 13 of large solid fuels, comprising coal, peat, wood, chips, trash, etc. A tube 29 connected to a compressor or blower opens into the curved portion below the grate for the supply of combustion air. When the generator is operating, a high velocity of reciprocating air, termed particle velocity, is obtained at the opening of the resonator where the grate is located. The resonator tube can be flared towards the opening thereof to form a diffuser, but the dimensions of the area of the grate, exposed to the interior of the resonator tube, in a plane transverse to the axis of the tube at the opening thereof, should be less than half the wave length of the sound generated by the sound generator. Then, there is obtained a high velocity reciprocating movement of combustion air and combustion gas through the fuel bed and the grate under the influence of the low frequency sound.

Under the influence of the high velocity of the reciprocating air combustion will be more intense, such that the content of unburnt gases and solid particles in the smoke will be reduced and the combustion rate increased.

Figure 2:
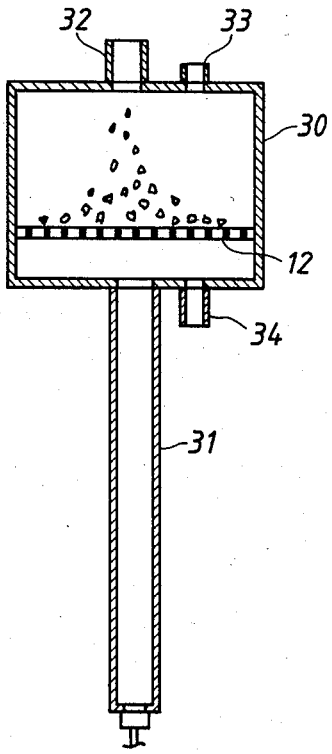
FIG. 2 is a diagrammatic vertical cross-sectional view of a combustion chamber according to the invention in one embodiment thereof.

The invention can also be applied to combustion chambers for the combustion of large solid fuels. When such fuel is combusted the fuel must stay in the combustion chamber for a period sufficiently long for the burning out of the fuel lumps. A chamber for this purpose is diagrammatically shown in FIG. 2 wherein the combustion chamber 30 is connected to a low frequency sound generator 31 at the opening of the resonance tube thereof. The sound generator also in this case can be of the type described in the patent referred to above. In the combustion chamber 30 a grate 12 is arranged close to the opening of the resonance tube, and the combustion chamber 30 has a shaft 32 with a sluice, not shown, for the supply of fuel at the top of the combustion chamber. Also an inlet 33 is arranged at the top of the combustion chamber for the supply of combustion air while an outlet 34 for flues is arranged at the bottom of the combustion chamber below the grate 12.

Figure 3:
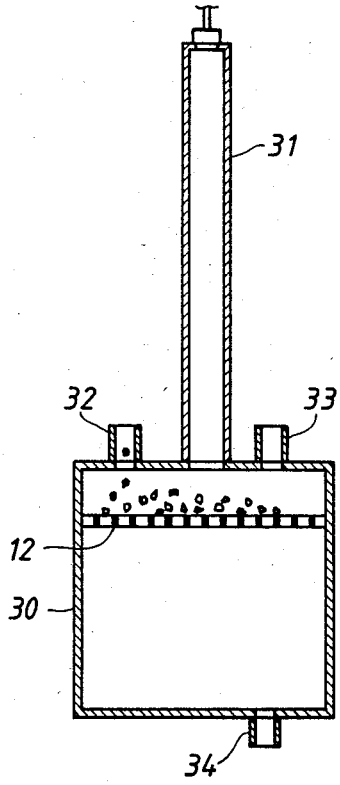
FIG. 3 is a view corresponding to FIG. 2 of a second embodiment.

The low frequency sound generator can be connected to the top of the combustion chamber as shown in FIG. 3. However, in the embodiment of FIG. 3 the grate 12 must be located in the uppermost portion of the combustion chamber 30 to be close to the opening of the low frequency sound generator 31. Problems may arise due to the fact that the space for the fuel supplied to the grate will be restricted when the grate is arranged in this manner. This problem can be overcome by providing the combustion chamber 30 with a passive resonator below the grate 12 as shown in FIG. 4.

Figure 4:
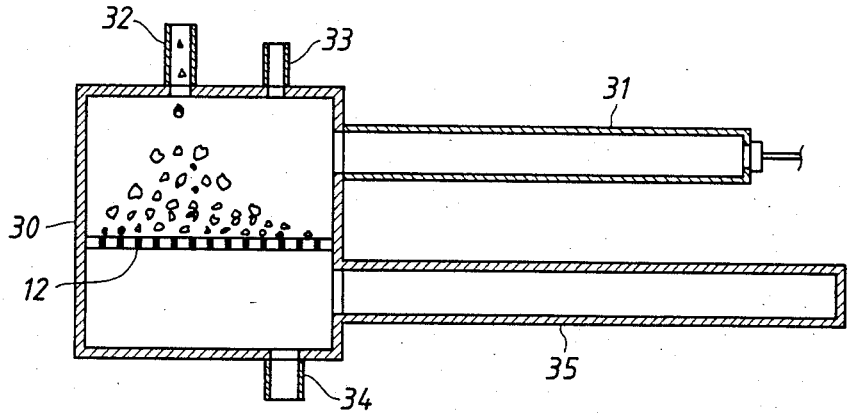
FIG. 4 is a view corresponding to FIG. 2 of a third embodiment.

In FIG. 4, a "passive" resonance tube 35 having a length which equals a quarter of a wave length, is connected to the combustion chamber 30 below the grate 12 at one side of the combustion chamber, the sound generator being connected to the combustion chamber at the same side thereof but above the grate 12. Also in this case there is a shaft 32 for the supply of fuel, a conduit 33 for the supply of auxiliary air as a supplement to that originally used for driving the sound generator 31 and then used as combustion air, and a flue gas outlet 34. The passive resonator 35 consists of a resonance tube closed at the outer end thereof, and due to the arrangement of this resonator the particle velocity will be substantially equal in all parts of the combustion chamber. Also the sound pressure will be substantially equal in the entire combustion chamber, however, lower than in case of no passive resonator being engaged.

An air volume will reciprocate not only at the opening of the low frequency sound generator but also at the opening of the passive generator and large air and combustion gas movements through the grate will occur as a consequence thereof, the combustion being intensified by such movement in the manner previously described.

Figure 5:
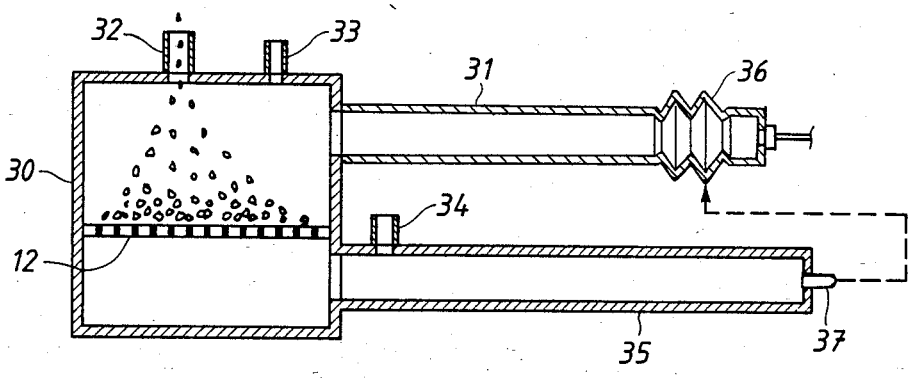
FIG. 5 is a view corresponding to FIG. 2 of a fourth embodiment.

The combustion chamber may be provided with heat absorbing walls. For example, the walls of the combustion chamber can be arranged for the circulation of water therein and water tubes in any previously known arrangement can be provided inside the combustion chamber by applying known techniques. However, it may be necessary to cool further the flue gas. If the flue gas is discharged from the combustion chamber through the opening of the passive resonator as shown in FIG. 5 wherein the flue outlet 34 is arranged in the wall of the passive resonator 35, the operation thereof will not be disturbed.

Since the gas temperature in the resonator of the low frequency sound generator is not the same as the gas temperature in the passive resonator, the two resonators must be dimensioned with regard to different temperatures. However, during operation the temperature may vary and in order to tune the one resonator to the other at each time, one resonator, e.g., the resonator of the sound generator, could be provided with a bellows system 36 such that the length thereof can be adjusted, as shown in FIG. 5. The bellows system in this arrangement should be provided with an adjustment mechanism which is operatively connected to a pressure sensor 37 at the closed end of the passive generator for adjustment of the length of the bellows system and thus the length of the resonator of the sound generator 31 responsive to the sound pressure at the closed end of the passive resonator 35 such that the resonator of the sound generator at any time will have the optimum length for maximum effect.

Figure 6:
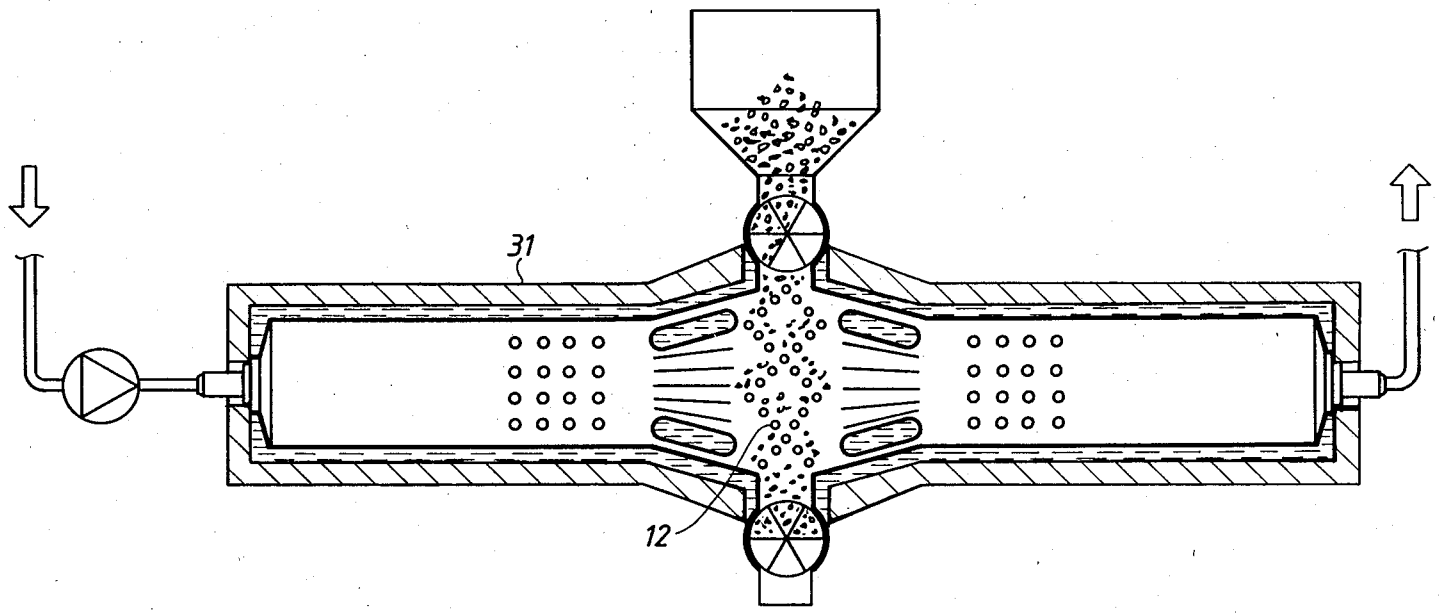
FIG. 6 is a vertical cross-sectional view of a constructive embodiment of a combustion chamber according to the invention of a half-wave type.

If the dimensions of the combustion chamber are related to the wave length such that they are less than half the wave length, the resonator tubes together with the combustion chamber can form one resonator. In FIG. 6 the resonator 31 is of the half-wave type being closed in both ends. The grate 12 is located in the longitudinal centre of the resonator where a particle velocity antinode is situated. In that part of the resonator where the grate is situated the resonator is expanded to suite a proper design of a combustion chamber. The combustion air can be supplied to the combustion process through a positive feed-back exigator of the type described in the U.S. Pat. No. 4,359,962, thereby simultaneously serving as drive gas for the exigator. The exhaust of the flue gases can be achieved in an analogical way through an exigator of the same type although in this case operating on negative feed-back.

Figure 7:
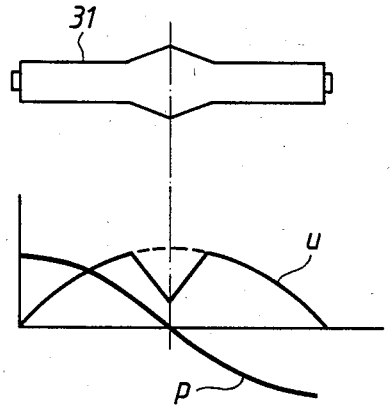
FIGS. 7 and 8 are diagrams illustrating the conditions obtained in the combustion chamber of FIG. 6.

The curves of FIG. 7 show the amplitudes of the sound pressure and the particle velocity, respectively, in cold state. The node of the sound pressure p and the antinode of the particle velocity u are situated at the longitudinal centre of the resonator.

Figure 8:
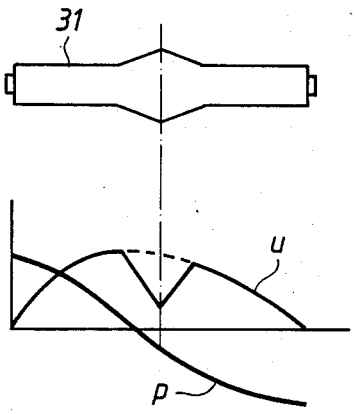

The curves given in FIG. 8 show the amplitudes during operation, i.e. in hot state, where the temperature of the flue gas causes the node and antinode, respectively, to move away from the longitudinal centre of the resonator. Therefore, to achieve that the grate is situated at the antinode of the particle velocity, the colder part of the resonator (where combustion air is introduced) is made shorter than the warmer part of the resonator (where flue gas is exhausted).

Figure 9:
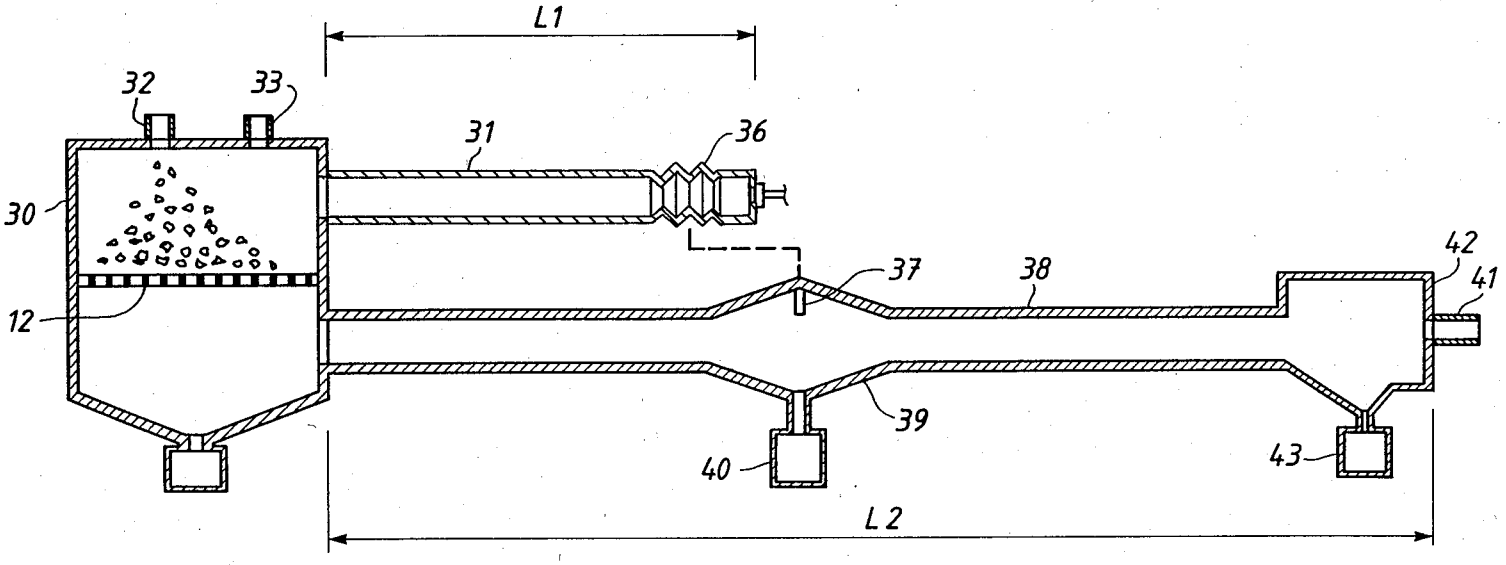
FIG. 9 is a diagrammatic vertical cross-sectional view of a combustion chamber according to the invention, with a three-quarter wave resonator.

A practical problem is to drive an exigator with flue gas, the gas being hot and possibly contaminated with dust. To overcome this, the resonator is extended to form a three-quarter wave resonator closed in one end and open in the other. From the open end the flue gas can be exhausted in a conventional way without employing an exigator. This arrangement is shown in FIG. 9 where the colder part of the resonator is shorter than half the length of the warmer part and adjustable to its length to facilitate that the antinode is located properly.

The three-quarter wave resonator will not operate at its first harmonic unless it is connected to a compensation cavity simulating an approximately free sound wave propagation.

The standing wave in the three-quarter wave resonator is maintained by pulses of pressurized gas fed into the closed, in this case the colder, end thereof. It is thereby a necessity that these gas pulses have the frequency of the first harmonic of the resonator. One way of securing this is to employ a positive feed-back exigator previously mentioned.

At the longitudinal centre of the warmer part of the resonator the particle velocity is at minimum and as a consequence thereof dust and other solid particles entrained in the flue gas passing through the resonator will fall out. Therefore, the resonator at this point is enlarged to form a knock-out box 39 from which the dust and other solid particles are collected in a container 40.

Figure 10:
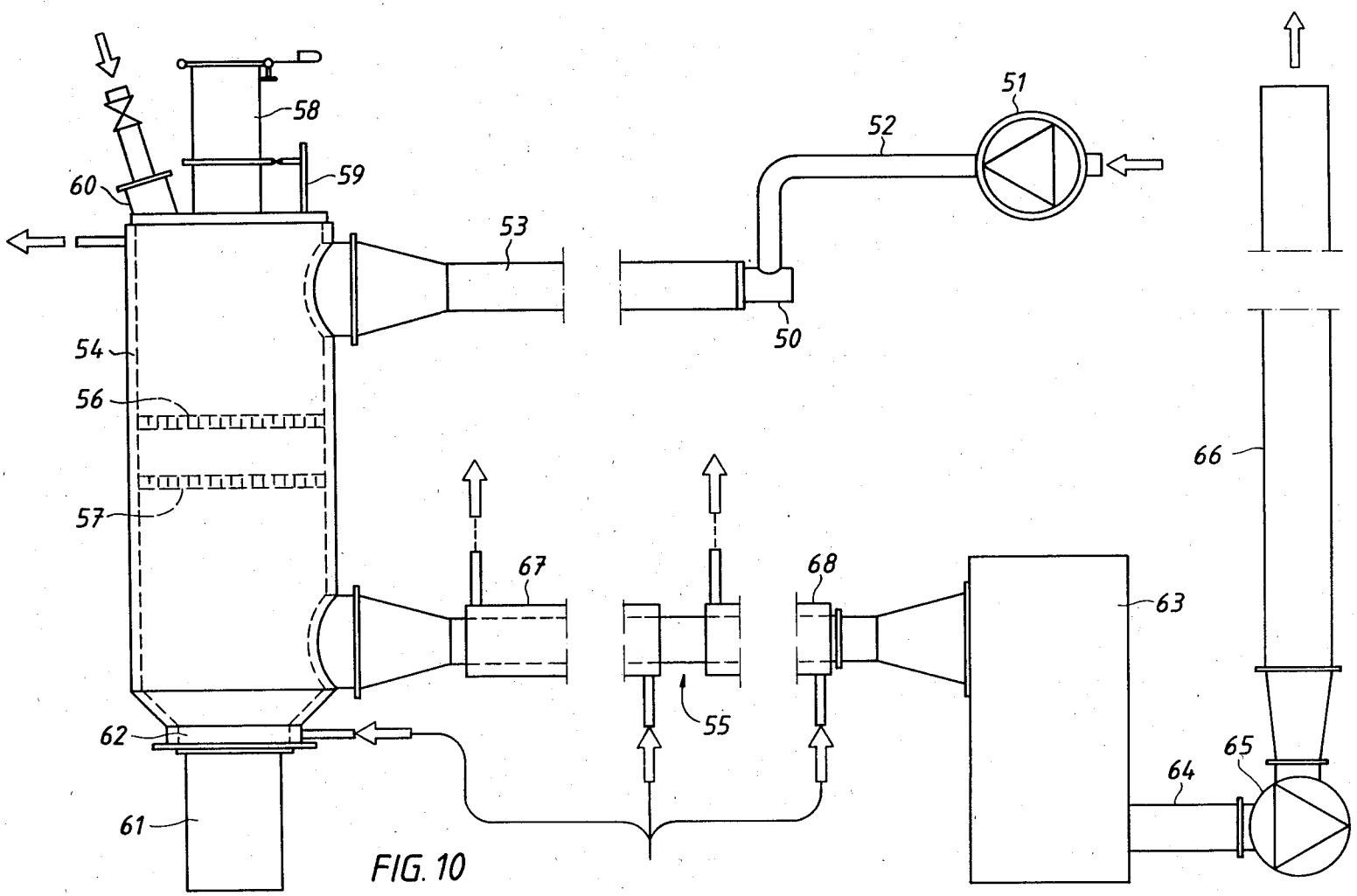
FIG. 10 is an elevational view of a constructive embodiment of a combustion chamber embodying the principles illustrated in FIG. 9.

FIG. 10 discloses a practical constructive embodiment of the system principally discussed above with reference to FIG. 9. In this embodiment, an exigator 50 of the type described in U.S. Pat. No. 4,359,962 is employed. The pressurized air is provided by a blower 51 which is connected by a conduit 52 to the exigator 50. A tube section 53 at one end of which the exigator is located, is connected at the other end thereof to a cylindrical vertical combustion chamber 54 at the top thereof. At the bottom the combustion chamber is connected to another tube section 55. In the cylindrical combustion chamber 54 two grates 56 and 57 are arranged substantially at the centre thereof one above the other. These grates are shown herein as conventional flat grates, but they can also be of other types. For example, they can be of the pyramidical type or they can be replaced by a single grate which extends helically from an upper level to a lower level.

A feeder 58 is connected to the top of the combustion chamber for the supply of large pieces of fuel, the feeder having a sluice 59 for feeding fuel portions intermittently into the combustion chamber. The combustion air is supplied by the blower 51 through the exigator 50 and auxiliary combustion air is drawn into the combustion chamber 54 through a trottled inlet 60 by the negative pressure inside the chamber.

At the bottom of the combustion chamber an ash container 61 isolated by a slide door 62 is provided for the collection of the ashes.

The tube sections 53 and 55 form together with the combustion chamber 54 a three-quarter wave resonator, the open end of which is connected to a compensation cavity 63. This cavity can be provided with means for discharging dust and other solid particles falling out therein, although such means are not shown herein. Close to the bottom of the compensation cavity 63 a flue duct 64 connects to an exhaust fan 65 for discharging the flue gas to the atmosphere through a chimney 66.

The combustion chamber 54 is provided with a water jacket for circulating water which takes up heat generated in the combustion chamber, and also the resonator tube section 55 is provided with water jackets 67 and 68 for cooling the flue gas when passing through the resonator in order to recover the heat contained therein.

In the set up shown in FIG. 10, totally 300 kg black coal was combusted during 6 hours. The average power obtained was 349 kW. The flue gas in the chimney had a very low content of dust and other solid particles. This is a remarkable observation, because when black coal is combusted in furnaces and boilers of conventional design, the content of dust and other solid particles in the flue gas before the gas is passed through a dust separator is in the order of 1 g per normal cubic meter of the gas while in the system of the invention the corresponding figure was only 50 mg. No smoke could be seen from the chimney. The low content of dust and other solid particles is due to the fact that the high particle velocity across the fuel bed brings about a substantially complete combustion of the black coal such that the flue gas contained no unburnt coal particles.

Normally, there is a relationship between the content of dust and other solid particles and the concentration of carbon monoxide in the flue gas. This is due to the fact that dust and other solid particles as well as carbon monoxide is generated when the combustion is incomplete. It was found in the test described above that the concentration of carbon monoxide was very low, which further confirms the beneficial effect of treatment by sound.

The test also showed that the content of nitrogen oxides in the flue gas was very low, which is another advantage achieved by a low frequency sound.

We claim:

1. A method for the combustion of large particles of solid fuel in a fuel bed located on a grate having certain dimensions in a plane extending therethrough, said method comprising the steps of (1) feeding combustion air toward said fuel bed so as to enable the large particles of solid fuel therein to combust and produce combustion gas, (2) generating high particle velocity sound having a maximum frequency of 60 Hz and a wavelength which is greater than twice said certain dimensions of said grate, and (3) directing said generated sound into the vicinity of said grate to provide a reciprocating movement of said combustion air and combustion gas through said fuel bed thereon, the reciprocating movement occurring in a direction perpendicular to said plane extending through said grate.

2. The method as claimed in claim 1, wherein said grate has a bottom surface and a top surface and wherein in step (3) said generated sound is directed towards the bottom surface of said grate.

3. The method as claimed in claim 1, wherein said grate has a bottom surface and a top surface and wherein in step (3) said generated sound is directed towards the top surface of said grate.

4. An apparatus for the combustion of large particles of solid fuel contained in a fuel bed, said apparatus comprising a grate on which said fuel bed is positionable, said grate having certain dimensions in a plane extending therethrough; means for supplying combustion air to said fuel bed so as to enable said large particles of solid fuel thereon to combust and produce combustion gas; and a low frequency sound generator, said low frequency generator generating low frequency sound having a maximum frequency of 60 Hz and a wavelength of more than twice said certain dimensions of said grate, said low frequency sound providing a high velocity of reciprocating air which is directed towards the vicinity of said grate to thus create a reciprocating movement of combustion air and combustion gas through said fuel bed on said grate in a direction perpendicular to said plane extending through said grate.

5. The apparatus as claimed in claim 4, wherein said low frequency sound generator comprises a tubular resonator.

6. The apparatus as claimed in claim 5, wherein said tubular generator includes a first portion which is straight and a second portion which curves upwardly to provide an upwardly open end, said grate being positioned on top of said upwardly open end of said second portion of said tubular generator.

7. The apparatus as claimed in claim 6, wherein said means for supplying combustion air comprises an inlet tube connected to said second portion of said tubular generator.

8. The apparatus as claimed in claim 5, including a combustion chamber in which said grate is located, said combustion chamber having a bottom wall, a top wall and side walls.

9. The apparatus as claimed in claim 8, wherein said tubular resonator is connected to said bottom wall.

10. The apparatus as claimed in claim 8, wherein said tubular resonator is connected to said top wall.

11. The apparatus as claimed in claim 8, wherein said tubular resonator is connected to one of said side walls at a point above the grate therein, and including a passive resonance tube which is connected to said one side wall at a point below the grate therein.

12. The apparatus as claimed in claim 11, wherein said tubular resonator includes a bellows means for changing the length thereof.

13. The apparatus as claimed in claim 11, including an outlet flue for combustion gas attached to said passive resonance tube.

14. The apparatus as claimed in claim 8, wherein said means for supplying combustion air to said fuel bed comprises an inlet pipe for combustion air connected to the top wall of said combustion chamber.

15. The apparatus as claimed in claim 4, wherein said low frequency sound generator comprises an elongated resonator that defines an enlarged combustion chamber along its length, said enlarged combustion chamber having certain dimensions in a plane extending therethrough, and wherein said grate is located within said enlarged combustion chamber.

16. The apparatus as claimed in claim 13, wherein said certain dimensions of said enlarged combustion chamber are less than half the wavelength of the sound generated by the low frequency sound generator.

* * * * *

UNITED STATES PATENT AND TRADEMARK OFFICE

CERTIFICATE OF CORRECTION

PATENT NO. : 4,592,292

DATED : June 3, 1986

INVENTOR(S) : Mats Olsson et al.

It is certified that error appears in the above-identified patent and that said Letters Patent is hereby corrected as shown below:

[30] Foreign Application Priority Data

December 2, 1983 Sweden ..... 8306652-2

Signed and Sealed this

*Nineteenth* Day of *August 1986*

[SEAL]

*Attest:*

DONALD J. QUIGG

*Attesting Officer*

*Commissioner of Patents and Trademarks*